US008313617B2

(12) United States Patent
Polat et al.

(10) Patent No.: US 8,313,617 B2
(45) **Date of Patent: *Nov. 20, 2012**

(54) PATTERNED FRAMEWORK FOR A PAPERMAKING BELT

(75) Inventors: Osman Polat, Montgomery, OH (US); Douglas Jay Barkey, Hamilton Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 114 days.

This patent is subject to a terminal disclaimer.

(21) Appl. No.: 12/859,501

(22) Filed: Aug. 19, 2010

(65) Prior Publication Data

US 2012/0043041 A1 Feb. 23, 2012

(51) Int. Cl.
*D21F 11/00* (2006.01)
*D04H 13/00* (2006.01)

(52) U.S. Cl. ..... 162/348; 162/358.2; 162/900; 162/903; 428/195.1; 442/50; 442/58; 442/103; 264/50; 264/58; 264/103

(58) Field of Classification Search ..... 162/348, 162/358.1–358.2, 900–904; 428/142, 156, 428/195.1; 442/43, 50, 58–59, 103, 218, 442/220; 139/383 R, 383 A; 264/136
See application file for complete search history.

(56) References Cited

U.S. PATENT DOCUMENTS 3,301,746 A 1/1967 Sanford et al.
3,556,932 A 1/1971 Coscia et al.
3,556,933 A 1/1971 Williams et al.
3,573,164 A 3/1971 Friedberg et al.
3,700,623 A 10/1972 Keim
3,772,076 A 11/1973 Keim
3,905,863 A 9/1975 Ayers
4,191,609 A 3/1980 Trokhan
4,239,065 A 12/1980 Trokhan
4,440,597 A 4/1984 Wells et al.
4,514,345 A 4/1985 Johnson et al.
4,528,239 A 7/1985 Trokhan
4,529,480 A 7/1985 Trokhan
4,637,859 A 1/1987 Trokhan
4,919,756 A 4/1990 Sawdai
5,098,522 A 3/1992 Smurkoski et al.
5,238,565 A 8/1993 Barcomb et al.
5,245,025 A 9/1993 Trokhan et al.
5,260,171 A 11/1993 Smurkoski et al.
(Continued)

OTHER PUBLICATIONS

Bejan, A., "Constructal Theory of Pattern Formation," *Hydrology and Earth System Sciences*, vol. 11, Jan. 17, 2007, pp. 753-768.

*Primary Examiner* — Jose A Fortuna
(74) *Attorney, Agent, or Firm* — Peter D. Meyer

(57) ABSTRACT

The present disclosure is directed toward a papermaking belt having a patterned framework having a continuous network region and a plurality of discrete deflection conduits isolated from one another by the continuous network region. The continuous network region has a pattern formed therein by a plurality of tessellating unit cells. Each cell has a center and at least two continuous land areas extending in at least two directions from the center. At least one of the continuous land areas at least bifurcates to form a continuous land area portion having a first width before bifurcation and at least two continuous land area portions having a second width after bifurcation where the at least two continuous land area portions are disposed at an angle ranging from about 1 degree to about 180 degrees relative to each other.

20 Claims, 9 Drawing Sheets

U.S. PATENT DOCUMENTS 5,275,700 A 1/1994 Trokhan
5,277,761 A 1/1994 Van Phan et al.
5,334,289 A 8/1994 Trokhan et al.
5,431,786 A 7/1995 Rasch et al.
5,443,691 A 8/1995 Phan et al.
5,496,624 A 3/1996 Stelljes, Jr. et al.
5,500,277 A 3/1996 Trokhan et al.
5,514,523 A 5/1996 Trokhan et al.
5,554,467 A 9/1996 Trokhan et al.
5,566,724 A 10/1996 Trokhan et al.
5,580,423 A 12/1996 Ampulski et al.
5,624,790 A 4/1997 Trokhan et al.
5,628,876 A 5/1997 Ayers et al.
5,679,222 A 10/1997 Rasch et al.
5,714,041 A 2/1998 Ayers et al.
5,906,710 A * 5/1999 Trokhan ..... 162/109
5,965,235 A * 10/1999 McGuire et al. ..... 428/156
6,010,598 A * 1/2000 Boutilier et al. ..... 162/348
6,099,781 A * 8/2000 Ampulski ..... 264/257
6,103,067 A * 8/2000 Stelljes et al. ..... 162/348
6,171,447 B1 * 1/2001 Trokhan ..... 162/358.2
6,358,594 B1 * 3/2002 Ampulski ..... 428/102
6,576,091 B1 * 6/2003 Cabell et al. ..... 162/348
6,660,362 B1 * 12/2003 Lin et al. ..... 428/131
6,664,505 B2 * 12/2003 Martin ..... 219/121.85
6,753,501 B1 * 6/2004 Costin et al. ..... 219/121.82
6,860,970 B2 * 3/2005 Ampulski ..... 162/359.1
7,128,809 B2 * 10/2006 Vinson et al. ..... 162/348
7,374,639 B2 * 5/2008 Ampulski et al. ..... 162/348
7,550,059 B2 6/2009 Van Phan et al.
8,163,130 B2 * 4/2012 Polat et al. ..... 162/109
2001/0037999 A1 * 11/2001 Martin ..... 219/121.85
2003/0139840 A1 * 7/2003 Magee et al. ..... 700/133
2003/0156738 A1 * 8/2003 Gerson et al. ..... 382/108
2004/0084167 A1 * 5/2004 Vinson et al. ..... 162/348
2006/0278298 A1 * 12/2006 Ampulski et al. ..... 139/383 B
2006/0280909 A1 * 12/2006 Kien et al. ..... 428/156
2008/0245498 A1 * 10/2008 Ostendorf et al. ..... 162/358.2
2010/0112320 A1 * 5/2010 Ostendorf et al. ..... 428/218
2010/0119779 A1 * 5/2010 Ostendorf et al. ..... 428/171
2012/0043036 A1 * 2/2012 Polat et al. ..... 162/116
2012/0043037 A1 * 2/2012 Polat et al. ..... 162/123
2012/0043041 A1 * 2/2012 Polat et al. ..... 162/289
2012/0043042 A1 * 2/2012 Polat et al. ..... 162/296
2012/0180971 A1 * 7/2012 Polat et al. ..... 162/358.2

* cited by examiner

PATTERNED FRAMEWORK FOR A PAPERMAKING BELT

FIELD OF THE INVENTION

The present invention is related to continuous papermaking machines. More particularly, the present invention relates to papermaking belts suitable for making paper products.

BACKGROUND OF THE INVENTION

Disposable products such as facial tissue, sanitary tissue, paper towels, and the like are typically made from one or more webs of paper. If the products are to perform their intended tasks, the paper webs from which they are formed must exhibit certain physical characteristics. Among the more important of these characteristics are strength, softness, and absorbency. Strength is the ability of a paper web to retain its physical integrity during use. Softness is the pleasing tactile sensation the user perceives as the user crumples the paper in his or her hand and contacts various portions of his or her anatomy with the paper web. Softness generally increases as the paper web stiffness decreases. Absorbency is the characteristic of the paper web which allows it to take up and retain fluids. Typically, the softness and/or absorbency of a paper web is increased at the expense of the strength of the paper web. Accordingly, papermaking methods have been developed in an attempt to provide soft and absorbent paper webs having desirable strength characteristics.

Processes for the manufacture of paper products generally involve the preparation of aqueous slurry of cellulosic fibers and subsequent removal of water from the slurry while contemporaneously rearranging the fibers to form an embryonic web. Various types of machinery can be employed to assist in the dewatering process. A typical manufacturing process employs the aforementioned Fourdrinier wire papermaking machine where a paper slurry is fed onto a surface of a traveling endless wire where the initial dewatering occurs. In a conventional wet press process, the fibers are transferred directly to a capillary de-watering belt where additional de-watering occurs. In a structured web process, the fibrous web is subsequently transferred to a papermaking belt where rearrangement of the fibers is carried out.

A preferred papermaking belt in a structured process has a foraminous woven member surrounded by a hardened photosensitive resin framework. The resin framework can be provided with a plurality of discrete, isolated channels known as deflection conduits. Such a papermaking belt can be termed a deflection member because the papermaking fibers deflected into the conduits become rearranged upon the application of a differential fluid pressure. The utilization of the belt in the papermaking process provides the possibility of creating paper having certain desired characteristics of strength, absorption, and softness. An exemplary papermaking belt is disclosed in U.S. Pat. No. 4,529,480.

Deflection conduits can provide a means for producing a Z-direction fiber orientation by enabling the fibers to deflect along the periphery of the deflection conduits as water is removed from the aqueous slurry of cellulosic fibers. The total fiber deflection is dependent on the size and shape of the deflection conduits relative to the fiber length. Large conduits allow smaller fibers to accumulate in the bottom of the conduit which in turn limits the deflection of subsequent fibers depositing therein. Conversely, small conduits allow large fibers to bridge across the conduit opening with minimal fiber deflection. Deflection conduits defined by a periphery forming sharp corners or small radii increase the potential for fiber bridging which minimizes fiber deflection. Exemplary conduit shapes and their effect on fiber bridging is described in U.S. Pat. No. 5,679,222.

As the cellulosic fibrous web is formed, the fibers are predominantly oriented in the X-Y plane of the web thereby providing negligible Z-direction structural rigidity. In a wet press process, as the fibers oriented in the X-Y plane are compacted by mechanical pressure, the fibers are pressed together increasing the density of the paper web while decreasing the thickness. In contrast, in a structured process, the orientation of fibers in the Z-direction of the web enhances the web's Z-direction structural rigidity and its corresponding resistance to mechanical pressure. Accordingly, maximizing fiber orientation in the Z-direction maximizes caliper.

A paper produced according to a structured web process can be characterized by having two physically distinct regions distributed across its surfaces. One region is a continuous network region which has a relatively high density and high intrinsic strength. The other region is one which is comprised of a plurality of domes which are completely encircled by the network region. The domes in the latter region have relatively low densities and relatively low intrinsic strength compared to the network region.

The domes are produced as fibers fill the deflection conduits of the papermaking belt during the papermaking process. The deflection conduits prevent the fibers deposited therein from being compacted as the paper web is compressed during a drying process. As a result, the domes are thicker having a lower density and intrinsic strength compared to the compacted regions of the web. Consequently, the caliper of the paper web is limited by the intrinsic strength of the domes. An exemplary formed paper is described in U.S. Pat. No. 4,637,859.

After the initial formation of the web, which later becomes the cellulosic fibrous structure, the papermaking machine transports the web to the dry end of the machine. In the dry end of a conventional machine, a press felt compacts the web into a single region of cellulosic fibrous structure having uniform density and basis weight prior to final drying. The final drying can be accomplished by a heated drum, such as a Yankee drying drum, or by a conventional de-watering press. Through air drying can yield significant improvements in consumer products. In a through-air-drying process, the formed web is transferred to an air pervious through-air-drying belt. This "wet transfer" typically occurs at a pick-up shoe, at which point the web may be first molded to the topography of the through air drying belt. In other words, during the drying process, the embryonic web takes on a specific pattern or shape caused by the arrangement and deflection of cellulosic fibers. A through air drying process can yield a structured paper having regions of different densities. This type of paper has been used in commercially successful products, such as Bounty® paper towels and Charmin® bath tissue. Traditional conventional felt drying does not produce a structured paper having these advantages. However, it would be desirable to produce a structured paper using conventional drying at speeds equivalent to, or greater than, a through air dried process.

Once the drying phase of the papermaking process is finished, the arrangement and deflection of fibers is complete. However, depending on the type of the finished product, paper may go through additional processes such as calendering, softener application, and converting. These processes tend to compact the dome regions of the paper and reduce the overall thickness. Thus, producing high caliper finished paper products having two physically distinct regions requires forming cellulosic fibrous structures in the domes having a resistance to mechanical pressure.

It would be advantageous to provide a wet pressed paper web having increased strength and wicking ability for a given level of sheet flexibility. It would be also be advantageous to provide a non-embossed patterned paper web having a relatively high density continuous network, a plurality of relatively low density domes dispersed throughout the continuous network, and a reduced thickness transition region at least partially encircling each of the low density domes.

SUMMARY OF THE INVENTION

A first embodiment of the present disclosure provides for a papermaking belt having an embryonic-web-contacting surface for carrying an embryonic web of paper fibers and a non-embryonic-web-contacting surface opposite the embryonic-web-contacting surface. The papermaking belt comprises a reinforcing structure having a patterned framework disposed thereon. The patterned framework has a continuous network region and a plurality of discrete deflection conduits. The deflection conduits are isolated from one another by the continuous network region. The continuous network region also comprises a pattern formed therein, the pattern having a plurality of tessellating unit cells. Each cell of the plurality of unit cells comprises a center, at least two continuous land areas extending in at least two directions from the center where each deflection conduit is surrounded by a portion of at least one of the continuous land areas. At least one of the continuous land areas at least bifurcates to form a continuous land area portion having a first width before the bifurcation and at least two continuous land area portions having a second width after the bifurcation. Each of the at least two continuous land area portions has a second width in continuous communication with the continuous land area portion having the first width. Each of the at least two continuous land area portions are disposed at an angle (θ) relative to each other ranging from about 1 degree to about 180 degrees.

Another embodiment of the present disclosure provides for a papermaking belt having an embryonic-web-contacting surface for carrying an embryonic web of paper fibers and a non-embryonic-web-contacting surface opposite the embryonic-web-contacting surface. The papermaking belt has a reinforcing structure having a patterned framework disposed thereon. The patterned framework has a continuous network region and a plurality of discrete deflection conduits. The deflection conduits are isolated from one another by the continuous network region. The continuous network region has a pattern formed therein, the pattern having a plurality of tessellating unit cells. Each cell of the plurality of unit cells comprises a center and at least two continuous land areas extending in at least two directions from the center. Each deflection conduit is surrounded by a portion of at least one of the continuous land areas. At least one of the continuous land areas at least bifurcates to form a continuous land area portion having a first width before the bifurcation and at least two continuous land area portions. A first of the at least two continuous land area portions has a second width and a second of the at least two continuous land area portions has a third width after the bifurcation. Each of the at least two continuous land area portions are in continuous communication with the continuous land area portion having the first width. Each of the at least two continuous land area portions are disposed at an angle (θ) relative to each other ranging from about 1 degree to about 180 degrees.

Still another embodiment of the present disclosure provides for a papermaking belt having an embryonic-web-contacting surface for carrying an embryonic web of paper fibers and a non-embryonic-web-contacting surface opposite the embryonic-web-contacting surface. The papermaking belt comprises a reinforcing structure having a patterned framework disposed thereon. The patterned framework has a continuous deflection conduit region and a plurality of discrete land areas. The discrete land areas are isolated from one another by the continuous deflection conduit region. The continuous deflection conduit region comprises a pattern formed therein. The pattern comprises a plurality of tessellating unit cells. Each cell of the plurality of tessellating unit cells comprises a center and at least two continuous pillow areas extending in at least two directions from the center. Each discrete land area is surrounded by a portion of at least one of the continuous deflection conduit region. At least one of the continuous deflection conduit region at least bifurcates to form a continuous deflection conduit portion having a first width before the bifurcation and at least two continuous deflection conduit portions having a second width after the bifurcation. Each of the at least two continuous deflection conduit portions having the second width are in continuous communication with the continuous deflection conduit portion having the first width. Each of the at least two continuous land area portions are disposed at an angle (θ) relative to each other ranging from about 1 degree to about 180 degrees.

DETAILED DESCRIPTION OF THE INVENTION

Papermaking Machine and Process

Figure 1:
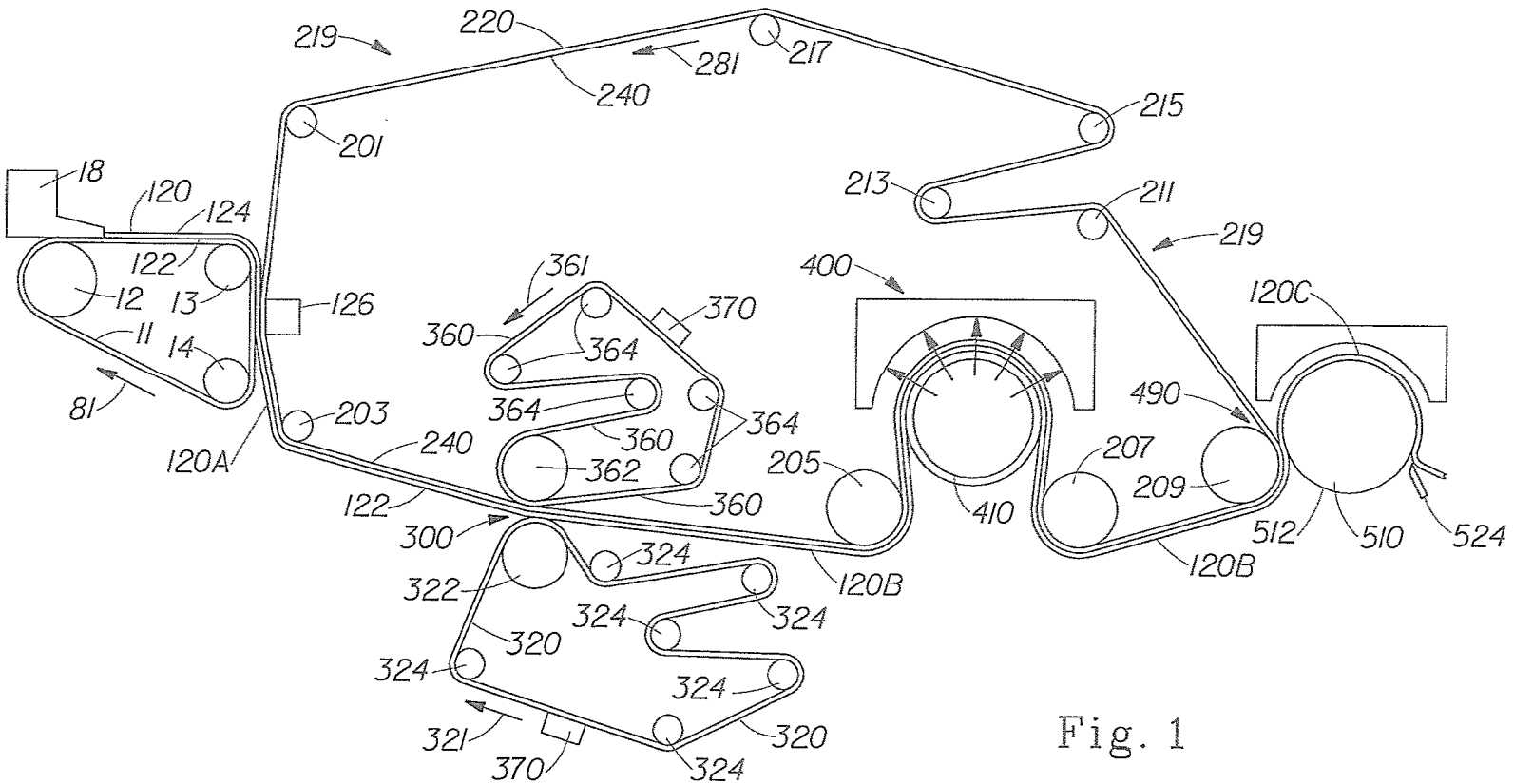
FIG. 1 is a schematic representation of one embodiment of a continuous papermaking machine which can be used to practice the present invention, and illustrating transferring a paper web from a foraminous forming member to a foraminous imprinting member, carrying the paper web on the foraminous imprinting member to a compression nip, and pressing the web carried on the foraminous imprinting member between first and second dewatering felts in the compression nip.

FIG. 1 illustrates an exemplary embodiment of a continuous papermaking machine which can be used in practicing the present invention. The process of the present invention comprises a number of steps or operations which occur in sequence. While the process of the present invention is preferably carried out in a continuous fashion, it will be understood that the present invention can comprise a batch operation, such as a handsheet making process. A preferred sequence of steps will be described, with the understanding that the scope of the present invention is determined with reference to the appended claims.

According to one embodiment of the present invention, an embryonic web 120 of papermaking fibers is formed from an aqueous dispersion of papermaking fibers on a foraminous forming member 11. The embryonic web 120 is then transferred to a foraminous imprinting member 219 having a first web contacting face 220 comprising a web imprinting surface and a deflection conduit portion. A portion of the papermaking fibers in the embryonic web 120 are deflected into deflection conduit portion of the foraminous imprinting member 219 without densifying the web, thereby forming an intermediate web 120A.

The intermediate web 120A is carried on the foraminous imprinting member 219 from the foraminous forming member 11 to a compression nip 300 formed by opposed compression surfaces on first and second nip rolls 322 and 362. A first dewatering felt 320 is positioned adjacent the intermediate web 120A, and a second dewatering felt 360 is positioned adjacent the foraminous imprinting member 219. The intermediate web 120A and the foraminous imprinting member 219 are then pressed between the first and second dewatering felts 320 and 360 in the compression nip 300 to further deflect a portion of the papermaking fibers into the deflection conduit portion of the imprinting member 219; to densify, a portion of the intermediate web 120A associated with the web imprinting surface; and to further dewater the web by removing water from both sides of the web, thereby forming a molded web 120B which is relatively dryer than the intermediate web 120A.

The molded web 120B is carried from the compression nip 300 on the foraminous imprinting member 219. The molded web 120B can be pre-dried in a through air dryer 400 by directing heated air to pass first through the molded web, and then through the foraminous imprinting member 219, thereby further drying the molded web 120B. The web imprinting surface of the foraminous imprinting member 219 can then be impressed into the molded web 120B such as at a nip formed between a roll 209 and a dryer drum 510, thereby forming an imprinted web 120C. Impressing the web imprinting surface into the molded web can further densify the portions of the web associated with the web imprinting surface. The imprinted web 120C can then be dried on the dryer drum 510 and creped from the dryer drum by a doctor blade 524.

Examining the process steps according to the present invention in more detail, a first step in practicing the present invention is providing an aqueous dispersion of papermaking fibers derived from wood pulp to form the embryonic web 120. The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene, polyester, and polypropylene fibers, may also be utilized in combination with natural cellulosic fibers. One exemplary polyethylene fiber which may be utilized is Pulpex™, available from Hercules, Inc. (Wilmington, Del.). Applicable wood pulps include chemical pulps, such as Kraft, sulfite, and sulfate pulps, as well as mechanical pulps including, for example, groundwood, thermomechanical pulp and chemically modified thermomechanical pulp. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

In addition to papermaking fibers, the papermaking furnish used to make paper product structures may have other components or materials added thereto as may be or later become known in the art. The types of additives desirable will be dependent upon the particular end use of the paper to product sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. Polyamide-epichlorohydrin resins are cationic wet strength resins which have been found to be of particular utility. Suitable types of such resins are described in U.S. Pat. Nos. 3,700,623 and 3,772,076. One commercial source of useful polyamide-epichlorohydrin resins is Hercules, Inc. of Wilmington, Del., which markets such resin under the mark Kymeme™ 557H.

Polyacrylamide resins have also been found to be of utility as wet strength resins. These resins are described in U.S. Pat. Nos. 3,556,932 and 3,556,933. One commercial source of polyacrylamide resins is American Cyanamid Co. of Stanford, Conn., which markets one such resin under the mark Parez™ 631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention. In addition, temporary wet strength resins such as Caldas 10 (manufactured by Japan Carlit) and CoBond 1000 (manufactured by National Starch and Chemical Company) may be used in the present invention. It is to be understood that the addition of chemical compounds such as the wet strength and temporary wet strength resins discussed above to the pulp furnish is optional and is not necessary for the practice of the present development.

The embryonic web 120 is preferably prepared from an aqueous dispersion of the papermaking fibers, though dispersions of the fibers in liquids other than water can be used. The fibers are dispersed in water to form an aqueous dispersion having a consistency of from about 0.1 to about 0.3 percent. The percent consistency of a dispersion, slurry, web, or other system is defined as 100 times the quotient obtained when the weight of dry fiber in the system under discussion is divided by the total weight of the system. Fiber weight is always expressed on the basis of bone dry fibers.

A second step in the practice of the present invention is forming the embryonic web 120 of papermaking fibers. Referring again to FIG. 1, an aqueous dispersion of papermaking fibers is provided to a headbox 18 which can be of any convenient design. From the headbox 18 the aqueous dispersion of papermaking fibers is delivered to a foraminous forming member 11 to form an embryonic web 120. The forming member 11 can comprise a continuous Fourdrinier wire. Alternatively, the foraminous forming member 11 can comprise a plurality of polymeric protuberances joined to a continuous reinforcing structure to provide an embryonic web 120 having two or more distinct basis weight regions, such as is disclosed in U.S. Pat. No. 5,245,025. While a single forming member 11 is shown in FIG. 1, single or double wire forming apparatus may be used. Other forming wire configurations, such as S or C wrap configurations can be used.

The forming member 11 is supported by a breast roll 12 and plurality of return rolls, of which only two return rolls 13 and 14 are shown in FIG. 1. The forming member 11 is driven in the direction indicated by the arrow 81 by a drive means (not shown). The embryonic web 120 is formed from the aqueous dispersion of papermaking fibers by depositing the dispersion onto the foraminous forming member 11 and removing a portion of the aqueous dispersing medium. The embryonic web 120 has a first web face 122 contacting the foraminous member 11 and a second oppositely facing web face 124.

The embryonic web 120 can be formed in a continuous papermaking process, as shown in FIG. 1, or alternatively, a batch process, such as a handsheet making process can be used. In any regard, after the aqueous dispersion of papermaking fibers is deposited onto the foraminous forming member 11, an embryonic web 120 is formed by removal of a portion of the aqueous dispersing medium by techniques well known to those skilled in the art. Vacuum boxes, forming boards, hydrofoils, and the like are useful in effecting water removal from the aqueous dispersion on the foraminous forming member 11. The embryonic web 120 travels with the forming member 11 about the return roll 13 and brought into the proximity of a foraminous imprinting member 219 described in detail infra.

A third step in the practice of the present invention comprises transferring the embryonic web 120 from the foraminous forming member 11 to the foraminous imprinting member 219, to position the second web face 124 on the first web contacting face 220 of the foraminous imprinting member 219. Although the preferred embodiment of the foraminous imprinting member 219 of the present invention is in the form of an endless belt, it can be incorporated into numerous other forms which include, for instance, stationary plates for use in making hand sheets or rotating drums for use with other types of continuous process. Regardless of the physical form which the foraminous imprinting member 219 takes for the execution of the claimed invention, it is generally provided with the physical characteristics detailed infra.

A fourth step in the practice of the present invention comprises deflecting a portion of the papermaking fibers in the embryonic web 120 into the deflection conduit portion 230 of web contacting face 220 of the foraminous imprinting member 219, and removing water from the embryonic web 120 through the deflection conduit portion 230 of the foraminous imprinting member 219 to form an intermediate web 120A of the papermaking fibers. The embryonic web 120 preferably has a consistency of between about 10 and about 20 percent at the point of transfer to facilitate deflection of the papermaking fibers into the deflection conduit portion 230 of the foraminous imprinting member 219.

The steps of transferring the embryonic web 120 to the imprinting member 219 and deflecting a portion of the papermaking fibers in the web 120 into the deflection conduit portion 230 of the foraminous imprinting member 219 can be provided, at least in part, by applying a differential fluid pressure to the embryonic web 120. For instance, the embryonic web 120 can be vacuum transferred from the forming member 11 to the imprinting member 219, such as by a vacuum box 126 shown in FIG. 1, or alternatively, by a rotary pickup vacuum roll (not shown). The pressure differential across the embryonic web 120 provided by the vacuum source (e.g. the vacuum box 126) deflects the fibers into the deflection conduit portion 230, and preferably removes water from the web through the deflection conduit portion 230 to raise the consistency of the web to between about 18 and about 30 percent. The pressure differential across the embryonic web 120 can range from between about 13.5 kPa and about 40.6 kPa (between about 4 to about 12 inHg). The vacuum provided by the vacuum box 126 permits transfer of the embryonic web 120 to the foraminous imprinting member 219 and deflection of the fibers into the deflection conduit portion 230 without compacting the embryonic web 120. Additional vacuum boxes (not shown) can be included to further dewater the intermediate web 120A.

A fifth step in the practice of the present invention comprises pressing the wet intermediate web 120A in the compression nip 300 to form the molded web 120B. Referring again to FIG. 1, the intermediate web 120A is carried on the foraminous imprinting member 219 from the foraminous forming member 11 and through the compression nip 300 formed between opposed compression surfaces on nip rolls 322 and 362. The first dewatering felt 320 is shown supported in the compression nip by the nip roll 322 and driven in the direction 321 around a plurality of felt support rolls 324. Similarly, the second dewatering felt 360 is shown supported in the compression nip 300 by the nip roll 362 and driven in the direction 361 around a plurality of felt support rolls 364. A felt dewatering apparatus 370, such as a Uhle vacuum box can be associated with each of the dewatering felts 320 and 360 to remove water transferred to the dewatering felts from the intermediate web 120A.

The nip rolls 322 and 362 can have generally smooth opposed compression surfaces, or alternatively, the rolls 322 and 362 can be grooved. In an alternative embodiment (not shown) the nip rolls can comprise vacuum rolls having perforated surfaces for facilitating water removal from the intermediate web 120A. The rolls 322 and 362 can have rubber coated opposed compression surfaces, or alternatively, a rubber belt can be disposed intermediate each nip roll and its associated dewatering felt. The nip rolls 322 and 362 can comprise solid rolls having a smooth, bonehard rubber cover, or alternatively, one or both of the rolls 322 and 362 can comprise a grooved roll having a bonehard rubber cover.

The term "dewatering felt" as used herein refers to a member that is absorbent, compressible, and flexible so that it is deformable to follow the contour of the non-monoplanar intermediate web 120A on the imprinting member 219, and capable of receiving and containing water pressed from an intermediate web 120A. The dewatering felts 320 and 360 can be formed of natural materials, synthetic materials, or combinations thereof.

A preferred but non-limiting dewatering felt 320, 360 can have a thickness of between about 2 mm to about 5 mm, a basis weight of about 800 to about 2000 grams per square meter, an average density (basis weight divided by thickness) of between about 0.35 gram per cubic centimeter and about 0.45 gram per cubic centimeter, and an air permeability of between about 15 and about 110 cubic feet per minute per square foot, at a pressure differential across the dewatering felt thickness of 0.12 kPa (0.5 inch of water). The dewatering felt 320 preferably has first surface 325 having a relatively high density, relatively small pore size, and a second surface 327 having a relatively low density, relatively large pore size. Likewise, the dewatering felt 360 preferably has a first surface 365 having a relatively high density, relatively small pore size, and a second surface 367 having a relatively low density, relatively large pore size. The relatively high density and relatively small pore size of the first felt surfaces 325, 365 promote rapid acquisition of the water pressed from the web in the nip 300. The relatively low density and relatively large pore size of the second felt surfaces 327, 367 provide space within the dewatering felts for storing water pressed from the web in the nip 300. Suitable dewatering felts 320 and 360 are commercially available as SUPERFINE DURAMESH, style XY31620 from the Albany International Company of Albany, N.Y.

The intermediate web 120A and the web imprinting surface 222 are positioned intermediate the first and second felt layers 320 and 360 in the compression nip 300. The first felt layer 320 is positioned adjacent the first face 122 of the intermediate web 120A. The web imprinting surface 222 is positioned adjacent the second face 124 of the web 120A. The second felt layer 360 is positioned in the compression nip 300 such that the second felt layer 360 is in flow communication with the deflection conduit portion 230.

Referring again to FIG. 1, the first surface 325 of the first dewatering felt 320 is positioned adjacent the first face 122 of the intermediate web 120A as the first dewatering felt 320 is driven around the nip roll 322. Similarly, the first surface 365 of the second dewatering felt 360 is positioned adjacent the second felt contacting face 240 of the foraminous imprinting member 219 as the second dewatering felt 360 is driven around the nip roll 362. Accordingly, as the intermediate web 120A is carried through the compression nip 300 on the foraminous imprinting fabric 219, the intermediate web 120A, the imprinting fabric 219, and the first and second dewatering felts 320 and 360 are pressed together between the opposed surfaces of the nip rolls 322 and 362. Pressing the intermediate web 120A in the compression nip 300 further deflects the paper making fibers into the deflection conduit portion 230 of the imprinting member 219, and removes water from the intermediate web 120A to form the molded web 120B. The water removed from the web is received by and contained in the dewatering felts 320 and 360. Water is received by the dewatering felt 360 through the deflection conduit portion 230 of the imprinting member 219.

Figure 2:
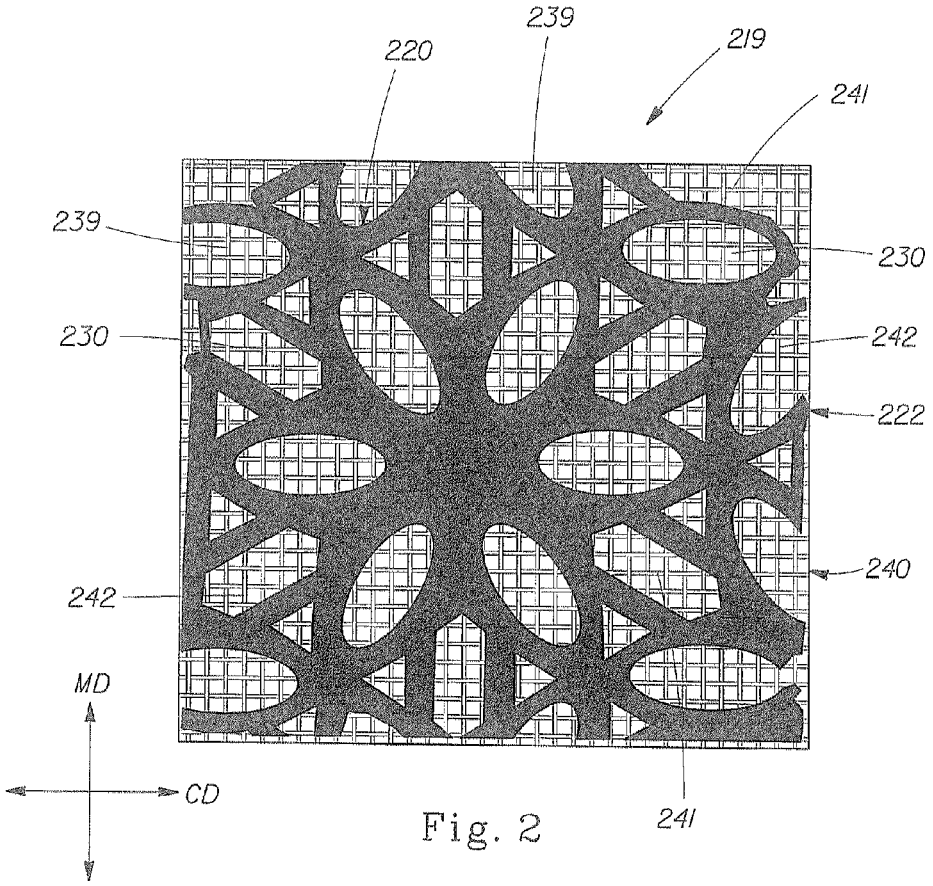
FIG. 2 is a schematic illustration of a plan view of a foraminous imprinting member formed from a plurality of unit cells having a first web contacting face comprising a macroscopically monoplanar, patterned continuous network web imprinting surface defining within the foraminous imprinting member a plurality of discrete, isolated, non connecting deflection conduits.
Figure 3:
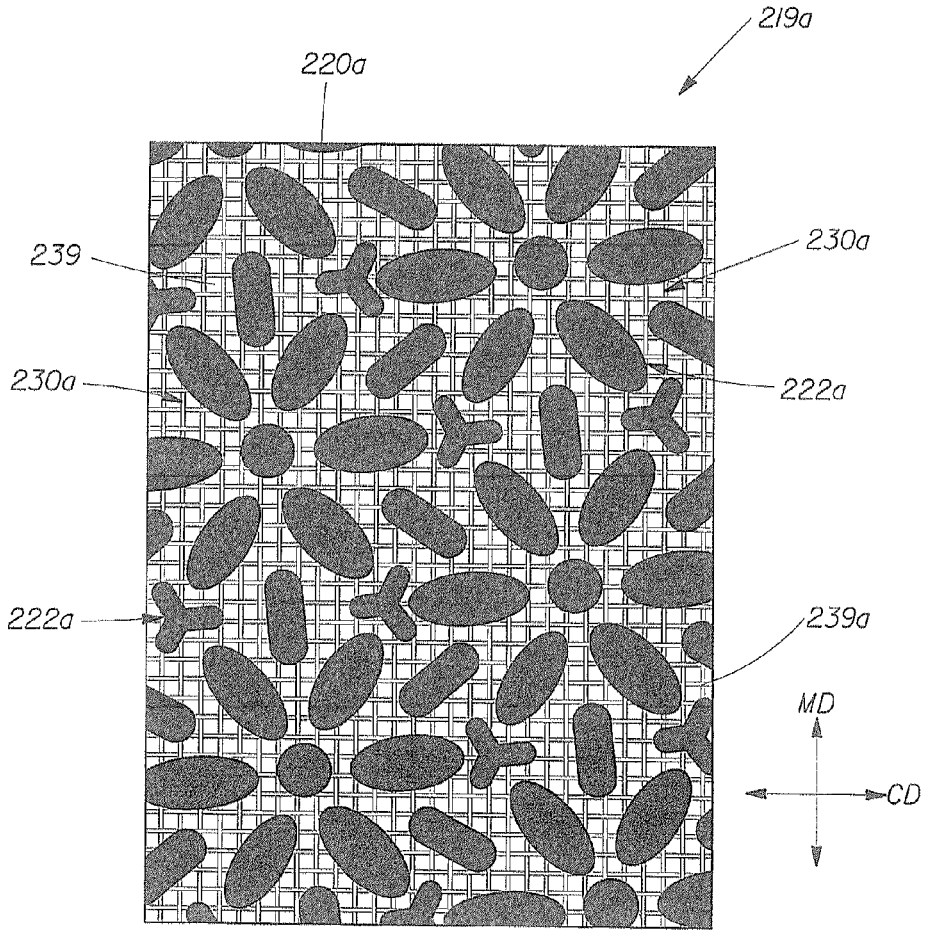
FIG. 3 is a schematic illustration of a plan view of an alternative foraminous imprinting member formed from a plurality of unit cells having a first web contacting face comprising a macroscopically monoplanar, patterned continuous network of deflection conduits defining within the foraminous member a plurality of discrete, isolated web imprinting surfaces.
Figure 4:
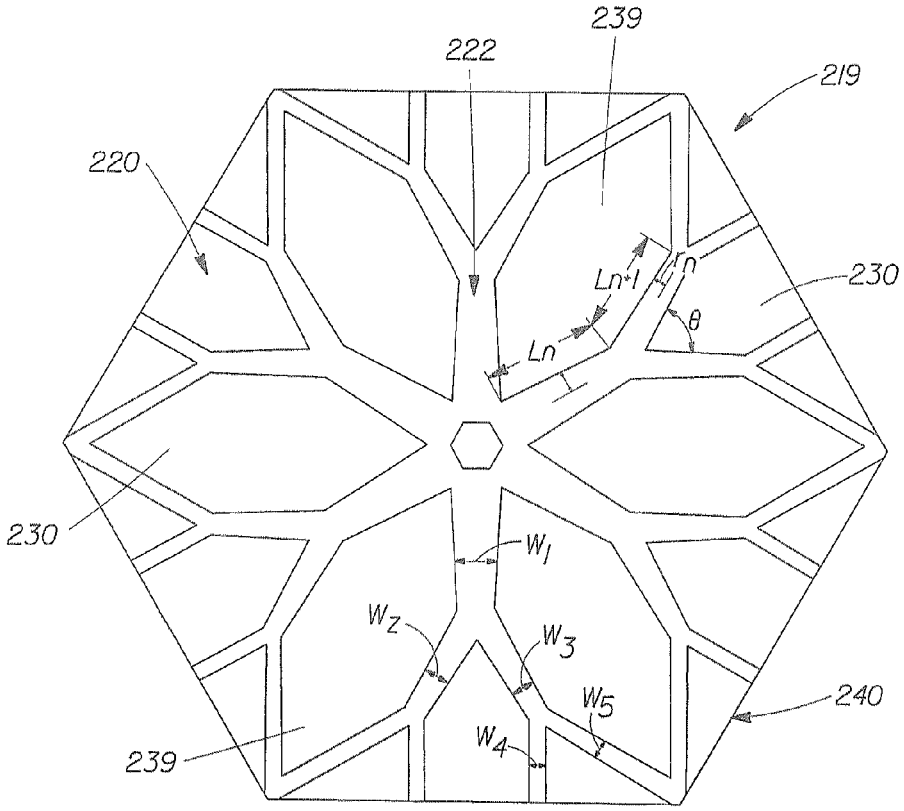
FIG. 4 is a schematic illustration of an exemplary unit cell where the land areas exhibit a geometric pattern that is repeated at ever smaller scales.
Figure 6:
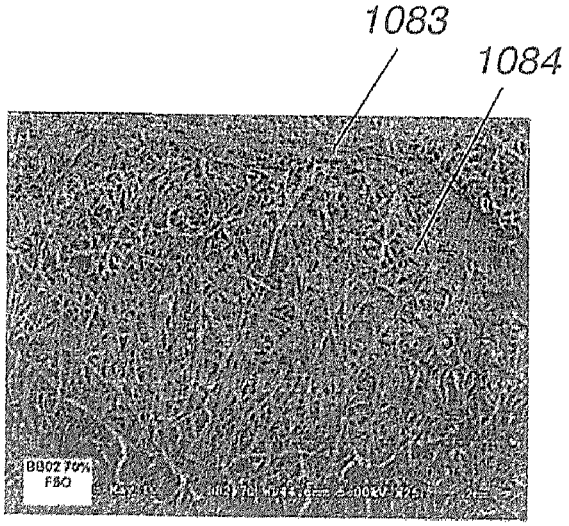
FIG. 6 is a photograph of a paper web made using the paper machine of FIG. 1 and the foraminous imprinting member of FIG. 2 showing relatively low density domes which are foreshortened by creping, the domes dispersed throughout a relatively high density, continuous network region.
Figure 7:
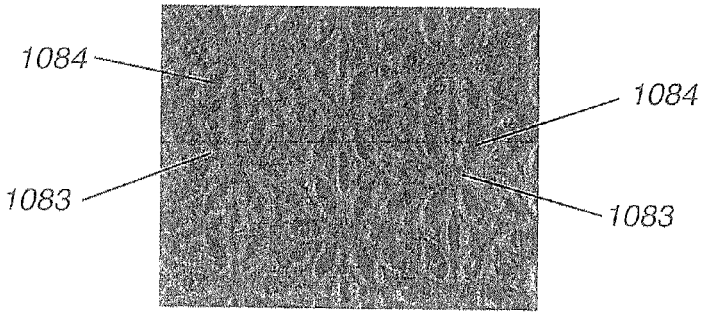
FIG. 7 is a photograph of the opposite side of the paper web of FIG. 5 showing the relatively low density domes dispersed throughout a relatively high density, continuous network region; and, FIGS. 8-12 show exemplary schematic illustrations of exemplary patterns suitable for use as continuous network web imprinting surfaces.

The molded web 120B is preferably pressed to have a consistency of at least about 30 percent at the exit of the compression nip 300. Pressing the intermediate web 120A as shown in FIG. 1 molds the web to provide a first relatively high density region 1083 associated with the web imprinting surface 222 and a second relatively low density region 1084 of the web associated with the deflection conduit portion 230. Pressing the intermediate web 120A on an imprinting fabric 219 having a macroscopically monoplanar, patterned, continuous network web imprinting surface 222, as shown in FIGS. 2-4, provides a molded web 120B having a macroscopically monoplanar, patterned, continuous network region 1083 having a relatively high density, and a plurality of discrete, relatively low density domes 1084 dispersed throughout the continuous, relatively high density network region 1083. Such a molded web 120B is shown in FIGS. 6 and 7. Such a molded web has the advantage that the continuous, relatively high density network region 1083 provides a continuous load path for carrying tensile loads.

A sixth step in the practice of the present invention can comprise pre-drying the molded web 120B, such as with a through-air dryer 400 as shown in FIG. 1. The molded web 120B can be pre-dried by directing a drying gas, such as heated air, through the molded web 120B. In one embodiment, the heated air is directed first through the molded web 120B from the first web face 122 to the second web face 124, and subsequently through the deflection conduit portion 230 of the imprinting member 219 on which the molded web is carried. The air directed through the molded web 120B partially dries the molded web 120B. In addition, without being limited by theory, it is believed that air passing through the portion of the web associated with the deflection conduit portion 230 can further deflect the web into the deflection conduit portion 230, and reduce the density of the relatively low density region 1084, thereby increasing the bulk and apparent softness of the molded web 120B. In one embodiment the molded web 120B can have a consistency of between about 30 and about 65 percent upon entering the through air dryer 400, and a consistency of between about 40 and about 80 upon exiting the through air dryer 400.

Referring to FIG. 1, the through air dryer 400 can comprise a hollow rotating drum 410. The molded web 120B can be carried around the hollow drum 410 on the imprinting member 219, and heated air can be directed radially outward from the hollow drum 410 to pass through the web 120B and the imprinting member 219. Alternatively, the heated air can be directed radially inward (not shown). Suitable through air dryers for use in practicing the present invention are disclosed in U.S. Pat. Nos. 3,303,576 and 5,274,930. Alternatively, one or more through air dryers 400 or other suitable drying devices can be located upstream of the nip 300 to partially dry the web prior to pressing the web in the nip 300.

A seventh step in the practice of the present invention can comprise impressing the web imprinting surface 222 of the foraminous imprinting member 219 into the molded web 120B to form an imprinted web 120C. Impressing the web imprinting surface 222 into the molded web 120B serves to further densify, the relatively high density region 1083 of the molded web, thereby increasing the difference in density between the regions 1083 and 1084. Referring to FIG. 1, the molded web 120B is carried on the imprinting member 219 and interposed between the imprinting s member 219 and an impression surface at a nip 490. The impression surface can comprise a surface 512 of a heated drying drum 510, and the nip 490 can be formed between a roll 209 and the dryer drum 510. The imprinted web 120C can then be adhered to the surface 512 of the dryer drum 510 with the aid of a creping adhesive, and finally dried. The dried, imprinted web 120C can be foreshortened as it is removed from the dryer drum 510, such as by creping the imprinted web 120C from the dryer drum with a doctor blade 524.

One of ordinary skill will recognize that the simultaneous imprinting, dewatering, and transfer operations may occur in embodiments other than those using dryer drum such as a Yankee drying drum. For example, two flat surfaces may be juxtaposed to form an elongate nip therebetween. Alternatively, two unheated rolls may be utilized. The rolls may be, for example, part of a calendar stack, or an operation which prints a functional additive onto the surface of the web. Functional additives may include: lotions, emollients, dimethicones, softeners, perfumes, menthols, combinations thereof, and the like.

The method provided by the present invention is particularly useful for making paper webs having a basis weight of between about 10 grams per square meter to about 65 grams per square meter. Such paper webs are suitable for use in the manufacture of single and multiple ply tissue and paper towel products.

Foraminous Imprinting Member

The foraminous imprinting member 219 has a first web contacting face 220 and a second felt contacting face 240. The web contacting face 220 has a web imprinting surface (or land area) 222 and a deflection conduit portion 230, as shown in FIGS. 2 and 4. The deflection conduit portion 230 forms at least a portion of a continuous passageway extending from the first face 220 to the second face 240 for carrying water through the foraminous imprinting member 219. Accordingly, when water is removed from the web of papermaking fibers in the direction of the foraminous imprinting member 219, the water can be disposed of without having to again contact the web of papermaking fibers. The foraminous imprinting member 219 can comprise an endless belt, as shown in FIG. 1, and can be supported by a plurality of rolls 201-217. The foraminous imprinting member 219 is driven in the direction 281 shown in FIG. 1 by a drive means (not shown). The first web contacting face 220 of the foraminous imprinting member 219 can be sprayed with an emulsion comprising about 90 percent by weight water, about 8 percent petroleum oil, about 1 percent cetyl alcohol, and about 1 percent of a surfactant such as Adogen TA-100. Such an emulsion facilitates transfer of the web from the imprinting member 219 to the drying drum 510. Of course, it will be understood that the foraminous imprinting member 219 need not comprise an endless belt if used in making handsheets in a batch process.

In one embodiment the foraminous imprinting member 219 can comprise a fabric belt formed of woven filaments. The foraminous imprinting member 219 can comprise a woven fabric. As one of skill in the art will recognize, woven fabrics typically comprise warp and weft filaments where warp filaments are parallel to the machine direction and weft filament are parallel to the cross machine direction. The interwoven warp and well filaments form discontinuous knuckles where the filaments cross over one another in succession. These discontinuous knuckles provide discrete imprinted areas in the molded web 120B during the papermaking process. As used herein the term "long knuckles" is used to define discontinuous knuckles formed as the warp and weft filaments cross over two or more warp or weft filament, respectively. Suitable woven filament fabric belts for use as the foraminous imprinting member 219 are disclosed in U.S. Pat. Nos. 3,301,746; 3,905,863; 4,191,609; and 4,239,065.

The knuckle imprint area of the woven fabric may be enhanced by sanding the surface of the filaments at the warp and weft crossover points. Exemplary sanded woven fabrics are disclosed in U.S. Pat. Nos. 3,573,164 and 3,905,863.

The absolute void volume of a woven fabric can be determined by measuring caliper and weight of a sample of woven fabric of known area. The caliper can measured by placing the sample of woven fabric on a horizontal flat surface and confining it between the flat surface and a load foot having a horizontal loading surface, where the load foot loading surface has a circular surface area of about 3.14 square inches and applies a confining pressure of about 15 g/cm$^2$ (0.21 psi) to the sample. The caliper is the resulting gap between the flat surface and the load foot loading surface. Such measurements can be obtained on a VIR Electronic Thickness Tester Model II available from Thwing-Albert, Philadelphia, Pa.

The density of the filaments can be determined while the density of the void spaces is assumed to be 0 gm/cc. For example, polyester (PET) filaments have a density of 1.38 g/cm$^3$. The sample of known area is weighed, thereby yielding the mass of the test sample.

Figure 5:
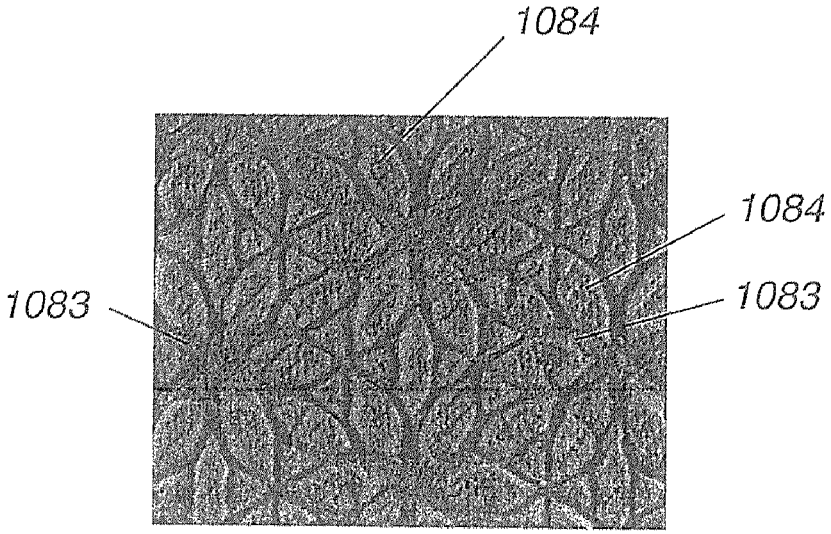
FIG. 5 is a photograph of a molded paper web formed using the foraminous imprinting member of FIG. 2 showing a land and a pillow area.

In another exemplary but non-limiting embodiment shown in FIGS. 2 and 4, the first web contacting face 220 of the foraminous imprinting member 219 comprises a macroscopically monoplanar, patterned, continuous network web imprinting surface 222. The plane of the foraminous imprinting member 219 defines its MD/CD (X-Y) directions. Perpendicular to the MD/CD directions and the plane of the imprinting fabric is the Z-direction of the imprinting fabric. The continuous network web imprinting surface 222 defines within the foraminous imprinting member 219 a plurality of discrete, isolated, non-connecting deflection conduits 230. The deflection conduits 230 have openings (pillow areas) 239 which can be random in shape and in distribution, but which are preferably of uniform shape and distributed in a repeating, preselected pattern on the first web contacting face 220. Such a continuous network web imprinting surface 222 and discrete deflection conduits 230 are useful for forming a paper structure having a continuous, relatively high density network region 1083 and a plurality of relatively low density domes 1084 dispersed throughout the continuous, relatively high density network region 1083, as shown in FIGS. 5-7.

Suitable shapes for the openings 239 include, but are not limited to, circles, ovals, and polygons formed by the boundaries circumscribed by the portions that form the web imprinting surface 222 as exemplified in FIGS. 2 and 4 and discussed infra. An exemplary foraminous imprinting member 219 having a continuous network web imprinting surface 222 and discrete isolated deflection conduits 230 suitable for use with the present invention can be manufactured according to the teachings of U.S. Pat. Nos. 4,514,345; 4,528,239; 4,529,480; 5,098,522; 5,260,171; 5,275,700; 5,328,565; 5,334,289; 5,431,786; 5,496,624; 5,500,277; 5,514,523; 5,554,467; 5,566,724; 5,624,790; 5,714,041; and, 5,628,876.

Alternatively, as shown in FIG. 3, the first web contacting face 220*a* of the foraminous imprinting member 219*a* comprises a macroscopically monoplanar, patterned, continuous deflection conduits 230*a*. The plane of the foraminous imprinting member 219*a* defines its MD/CD (X-Y) directions. Perpendicular to the MD/CD directions and the plane of the imprinting fabric is the Z-direction of the imprinting fabric. The continuous deflection conduits 230*a* defines within the foraminous imprinting member 219*a* a plurality of discrete, isolated, non-connecting web imprinting surfaces 222*a*. The deflection conduits 230*a* have a continuous opening 239*a* which defines the shape of the web imprinting surfaces 222*a*. The web imprinting surfaces 222*a* are preferably distributed in a repeating, preselected pattern on the first web contacting face 220*a*.

Web Imprinting Surface

Referring again to FIGS. 2 and 4, the continuous network web imprinting surface 222 (and alternatively the continuous deflection conduits 230*a* of FIG. 3 and the physical and numerical corresponding components thereof) is provided with a geometric shape that can be split into parts, each of which is (at least approximately) a reduced-size copy of the whole. This is known to those of skill in the art as the property of self-similarity. These shapes: 1. Have a fine structure at arbitrarily small scales, 2. Are generally too irregular to be easily described in traditional Euclidean geometric language, 3. Are self-similar (at least approximately or stochastically), 4. Have a Hausdorff dimension that is greater than its topological dimension (although this requirement is not to met by space-filling curves such as the Hilbert curve), and 5. Have a simple and recursive definition. The geometric shapes preferably have either exact self-similarity (appears identical at different scales) or quasi-self-similarity (appears approximately identical at different scales).

Examples of geometric shapes suitable for use with the present invention and forming the continuous network web imprinting surface 222 include fractals and constructals. Because they appear similar at all levels of magnification, fractals are often considered to be infinitely complex (in informal terms). Images of fractals suitable for use with the present invention and capable of providing the desired continuous network web imprinting surface 222 can be created using fractal-generating software. Images produced by such software are normally referred to as being fractals even if they do not have the above characteristics, such as when it is possible to zoom into a region of the fractal that does not exhibit any fractal properties. Also, these may include calculation or display artifacts which are not characteristics of true fractals. Exemplary, but non-limiting techniques for generating fractals are: 1. Escape-time fractals (also known as "orbits" fractals and are defined by a formula or recurrence relation at each point in a space, for example Mandelbrot set, Julia set, the Burning Ship fractal, the Nova fractal and the Lyapunov fractal), 2. Iterated function systems (have a fixed geometric replacement rule, for example Cantor set, Sierpinski carpet, Sierpinski gasket, Peano curve, Koch snowflake, Harter-Highway dragon curve, T-Square, Menger sponge), 3. Random fractals (Generated by stochastic rather than deterministic processes, for example, trajectories of the Brownian motion, Lévy flight, fractal landscapes and the Brownian tree), and 4. Strange attractors (Generated by iteration of a map or the solution of a system of initial-value differential equations that exhibit chaos).

An exemplary but non-limiting fractal, the Mandelbrot set, is based on the multiplication of the complex numbers. Start with a complex number $z_0$. From $z_0$ define $z_1=(z_0)^2+z_0$. Assuming that is known, $z_{x+1}$ is defined to be $(z_x)^2+z_x$. The points in the Mandelbrot set are all those points which stay relatively close to the point 0+0i (in the sense that they are always within some fixed distance of (0+0i) as we repeat this process. As it turns out, if $z_x$ is ever outside of the circle of radius 2 about the origin for some n, it won't be in the Mandelbrot set.

In contrast to fractal models of phenomena, constructal law is predictive and thus can be tested experimentally. Constructal theory puts forth the idea that the generation of design (configuration, pattern, geometry) in nature is a physics phenomenon that unites all animate and inanimate systems. For example, in point-area and point-volume flows, constructal theory predicts tree architectures, such flows displaying at least two regimes: one highly resistive and a less resistive one. Constructal theory can be applied at any scale: from macroscopic to microscopic systems. The constructal way of distributing any system's imperfection is to put the more resistive regime at the smallest scale of the system. The constructal law is the principle that generates the perfect form, which is the least imperfect form possible.

In order to mathematize the constructal law new properties for a thermodynamic system were defined that distinguish the thermodynamic system from a static (equilibrium, nothing flows) system, that does not have configuration. The properties of a flow system are:

(1) global external size, e.g., the length scale of the body bathed by the tree flow L;
(2) global internal size, e.g., the total volume of the ducts V;
(3) at least one global measure of performance, e.g., the global flow resistance of the tree R;
(4) configuration, drawing, architecture; and
(5) freedom to morph, i.e., freedom to change the configuration.

The global external and internal sizes (L, V) mean that a flow system has at least two length scales L and $V^{1/3}$. These form a dimensionless ratio—the svelteness $S_v$—which is a new global property of the flow configuration (Lorente and Bejan, 2005).

$$S_v = \frac{\text{external flow length scale}}{\text{internal flow length scale}} = \frac{L}{V^{1/3}}$$

Constructal law is the statement that summarizes the common observation that flow structures that survive are those that morph (evolve) in one direction in time: toward configurations that make it easier for currents to flow. This statement refers strictly to structural changes under finite-size constraints. If the flow structures are free to change), in time they will move at constant L and constant V in the direction of progressively smaller R. Constructal law requires:

$$R_2 \leqq R_1(\text{constant } L, V)$$

If freedom to morph persists, then the flow structure will continue toward smaller R values. Any such change is characterized by:

$$dR \leqq 0(\text{constant } L, V)$$

The end of this migration is the "equilibrium flow structure", where the geometry of the flow enjoys total freedom. Equilibrium is characterized by minimal R at constant L and V. In the vicinity of the equilibrium flow structure we have:

$$dR=0 \text{ and } d^2R>0(\text{constant } L, V)$$

The R(V) curve generated is the edge of the cloud of possible flow architectures with the same global size L. The curve has negative slope because of the physics of flow: the resistance decreases when the flow channels open up:

$$\left(\frac{\partial R}{\partial V}\right)_L < 0$$

The evolution of configurations in the constant-V cut (also at constant L) represents survival through increasing performance—survival of the fittest. The idea of constructal-law is that freedom to morph is good for performance.

The same time arrow can be described alternatively with reference to the constant-R cut through three-dimensional space. Flow architectures with the same global performance (R) and global size (L) evolve toward compactness and sveltness—smaller volumes dedicated to internal ducts, i.e., larger volumes reserved for the working "tissue" (the interstices). The global external and internal sizes (L, V) mean that a flow system has scales L and $V^{1/3}$. These form a dimensionless ratio (svelteness, $S_v$) that is a property of the flow configuration. For a system with fixed global size and global performance to persist in time (to live), it must evolve in such a way that its flow structure occupies a smaller fraction of the available space. This is survival based on the maximization of the use of the available space. Survival by increasing $S_v$ (compactness) is equivalent to survival by increasing performance.

A third equivalent statement of the constructal law becomes evident if the constant-L design is recast in constant-V design space. The contribution of the shape and orientation of the hyper-surface of non-equilibrium flow structures provides for the slope of the curve in the bottom plane $(\partial R/\partial L)_V$ is positive. This is because the flow resistance increases when the distance traveled by the stream increases. The flow structures of a certain performance level (R) and internal flow volume (V) morph into new flow structures that cover progressively larger territories. Again, flow configurations evolve toward greater $S_v$.

The geometries of the continuous network web imprinting surface 222 shown in FIG. 2 provide for a plurality of tessellating unit cells (representatively shown in FIG. 3). Each unit cell is provided with a centroid where each first land area having a width ($W_1$) forming the continuous network web imprinting surface 222 emanates from. Each land area is preferentially at least bifurcates into additional land areas (e.g., second land area, third land area, etc.) each having a width (e.g., $W_2$, $W_3$, etc.) that is different from the width of first land area ($W_1$). Each additional land area (e.g., second land area, third land area, etc.) can then at least bifurcate into yet further additional land areas having widths that are different from those of the additional land areas.

In the example provided in FIG. 4, the design is similar to that of vascular branching. The analytical method described by Rosen (Ch. 3 in Optimality Principles in Biology, Robert Rosen, Butterworths, London, 1967) can be used to determine the widths and lengths of the branches and the angles between them. Optimizing the radii (r) of the capillary channels and their lengths (L) by considering capillary pressure and Hagen-Poiseuille drag, results in the relationships between $L_n$, $r_n$, $L_{n+1}$, $r_{n+1}$, and θ as shown in FIG. 4.

Since $L_n$, $r_n$, $L_{n+1}$, and $r_{n+1}$ are typically used to describe the relationships in naturally occurring capillary-like systems having 3-dimensions, it should be readily clear to one of skill in the art the land areas of the continuous network regions of the description herein will reference a width (W) because the structures of the instant disclosure are essentially macroscopically mono-planar in the machine and cross-machine directions. It would be understood by one of skill in the art that in such a circumstance that 2r=W. It should also be understood by one of skill in the art that in order to account for design choice (e.g., linear, tapered, curvilinear, etc.) and/or deal with the nuances of manufacturing, the width (W) shown and used for the basis of the present disclosure is preferably an average width of the region. Further it should be understood by one of skill in the art that even though the exemplary representative capillary-like systems depicted herein are shown as having linear characteristics, the capillary-like systems of the present disclosure could have any shape including curvilinear, combinations of linear and curvilinear designs, and the like.

Additionally, in the example provided in FIG. 4, first land area having a width ($W_1$) bifurcates into two additional land areas each having a respective width ($W_2$ and $W_3$). Four scenarios can emerge from the resultant bifurcation of the first land area having a width ($W_1$) into two additional land areas each having a respective width ($W_2$ and $W_3$). These scenarios are:

$$W_1 = W_2 + W_3, \text{ where } W_2 \text{ and } W_3 \neq 0; \quad 1$$

$$W_1 < W_2 + W_3, \text{ where } W_2 \text{ and } W_3 \neq 0; \quad 2$$

$$W_1 = W_2 + W_3, \text{ where } W_2 \neq W_3, \text{ and where } W_2, W_3 > 0; \text{ and,} \quad 3$$

$$W_1 < W_2 + W_3, \text{ where } W_2 \neq W_3, \text{ and where } W_2, W_3 > 0. \quad 4$$

It was found advantageous that the values of L, W, and θ be selected in order to provide the best correlation between repeating tessellating unit cells. While one of skill in the art could provide any value of L, W, and θ to suit the need, it was found that $L_1$ (pre-bifurcation) and $L_2$, $L_3$ (post bifurcation) could range from between about 0.005 inches to about 0.750 inches and/or about 0.010 inches to about 0.400 inches and/or about 0.020 inches to about 0.200 inches and/or about 0.03 inches to about 0.100 inches and/or about 0.05 inches to about 0.075 inches. It was also found that $W_1$ (pre-bifurcation) and $W_2$, $W_3$ (post bifurcation) could range from between about 0.005 inches to about 0.200 inches and/or about 0.010 inches to about 0.100 inches and/or about 0.015 inches to about 0.075 inches and/or about 0.020 inches to about 0.050 inches. It was also found that θ could range from about 1 degree to about 180 degrees and/or from about 30 degrees to about 140 degrees and/or from about 30 degrees to about 120 degrees and/or from about 40 degrees to about 85 degrees and/or from about 45 degrees to about 75 degrees and/or from about 50 degrees to about 70 degrees.

It was surprisingly found that a web product formed by the use of a web imprinting surface 222 having a continuous network web imprinting surface 222 with a geometry exhibited by equation 2 (above) and the values of L, W, and θ described above exhibited several remarkable performance enhancements. This included a surprising increase in the observed VFS, and SST values and a surprising decrease in the observed residual water values ($R_W$) over other commercial products tested.

Referring again to FIGS. 2, 4, and 5, the foraminous imprinting member 219 can include a woven reinforcement element 243 for strengthening the foraminous imprinting member 219. The reinforcement element 243 can include machine direction reinforcing strands 242 and cross machine direction reinforcing strands 241, though any convenient weave pattern can be used. The openings in the woven reinforcement element 243 formed by the interstices between the strands 241 and 242 are smaller than the size of the openings 239 of the deflection conduits 230. Together, the openings in the woven reinforcement element 243 and the openings 239 of the deflection conduits 230 provide a continuous passageway extending from the first face 220 to the second face 240 for carrying water through the foraminous imprinting member 219. The reinforcement element 243 can also provide a support surface for limiting deflection of the fibers into the deflection conduits 230, and thereby help to prevent the formation of apertures in the portions of the web associated with the deflection conduits 230, such as the relatively low density domes 1084. Such apertures, or pinholing, can be caused by water or air flow through the deflection conduits when a pressure difference exists across the web. If one does not wish to use a woven fabric for the reinforcing element 243, a non-woven element, screen, scrim, net, or a plate having a plurality of holes therethrough may provide adequate strength and support for the web imprinting surface 222 of the present invention.

The area of the web imprinting surface 222, as a percentage of the total area of the first web contacting surface 220, should be between about 15 percent to about 65 percent, and more preferably between about 20 percent to about 50 percent to provide a desirable ratio of the areas of the relatively high density region 1083 and the relatively low density domes 1084. The size of the openings 239 of the deflection conduits 230 in the plane of the first face 220 can be expressed in terms of effective free span. Effective free span is defined as the area of the opening 239 in the plane of the first face 220 divided by one fourth of the perimeter of the opening 239. The effective free span should be from about 0.25 to about 3.0 times the average length of the papermaking fibers used to form the embryonic web 120, and is preferably from about 0.5 to about 1.5 times the average length of the papermaking fibers. The deflection conduits 230 can have a depth which is between about 0.1 mm and about 1.0 mm.

The caliper of the woven fabric may vary, however, in order to facilitate the hydraulic connection between the molded web 120B and a dewatering felt 320, 360 the caliper of the imprinting fabric may range from about 0.011 inch (0.279 mm) to about 0.026 inch (0.660 mm).

Preferably, the continuous network web imprinting surface 222 extends outwardly (i.e., has an overburden) from the reinforcing element 243 of greater than about 0.006 inch and/or greater than about 0.010 inch and/or greater than about 0.015 inch and/or greater than about 0.020 inch and/or greater than about 0.030 inch and/or greater than about 0.050 inch. However, it may be possible to provide the continuous network web imprinting surface 222 with an overburden that is less than about 0.15 mm (0.006 inch), more preferably less than about 0.10 mm (0.004 inch) and still more preferably less than about 0.05 mm (0.002 inch), and most preferably less than about 0.1 mm (0.0004 inch). It is believed that the continuous network web imprinting surface 222 could be substantially coincident (or even coincident) with the elevation of the reinforcing element 243.

Figure 8:
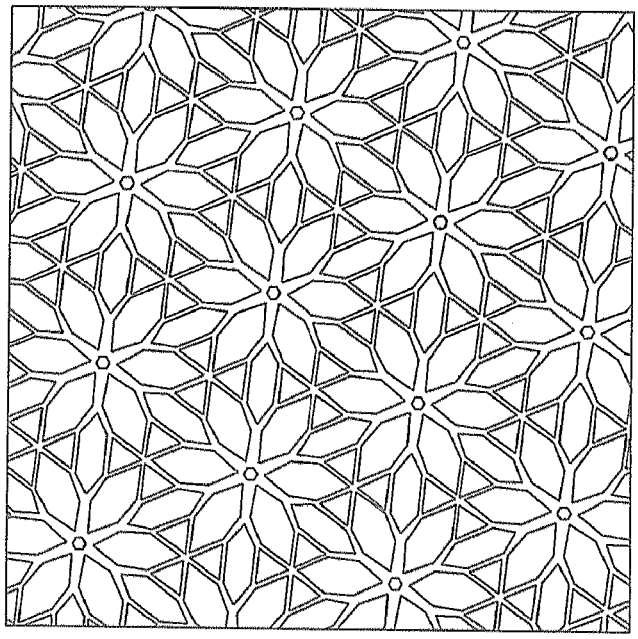
FIGS. 8-9 show exemplary patterns of relatively low density domes dispersed throughout a relatively high density, continuous network region having a fractal geometric pattern.
Figure 9:
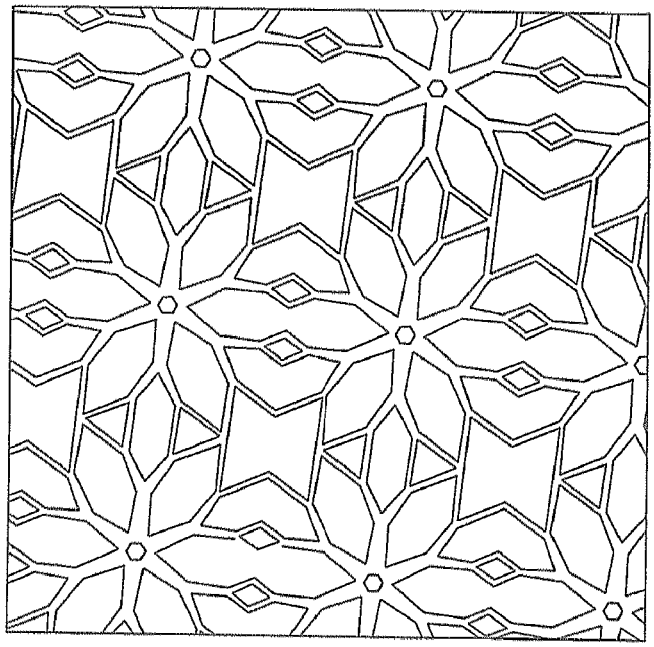
Figure 10:
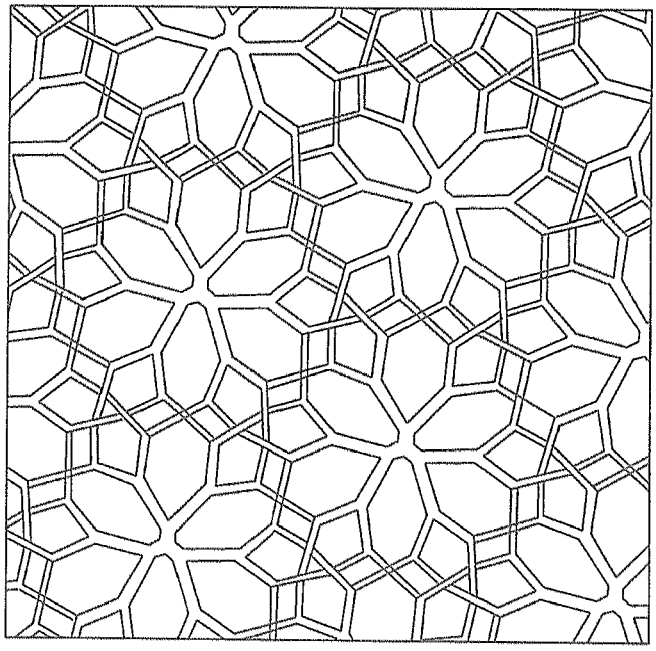
FIG. 10 shows an exemplary pattern of relatively low density domes dispersed throughout a relatively high density, continuous network region having a constructal geometric pattern.
Figure 11:
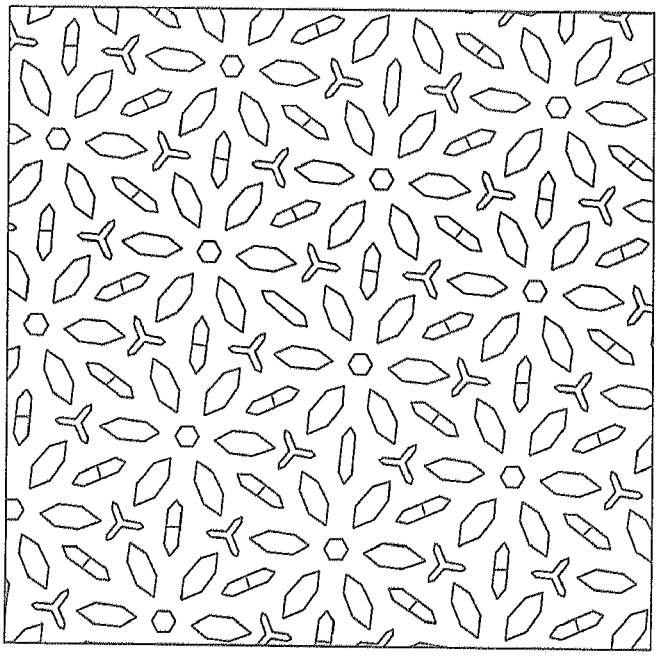
FIG. 11 shows an exemplary pattern of relative high density areas dispersed throughout a relatively low density, continuous network region having a fractal geometric pattern.
Figure 12:
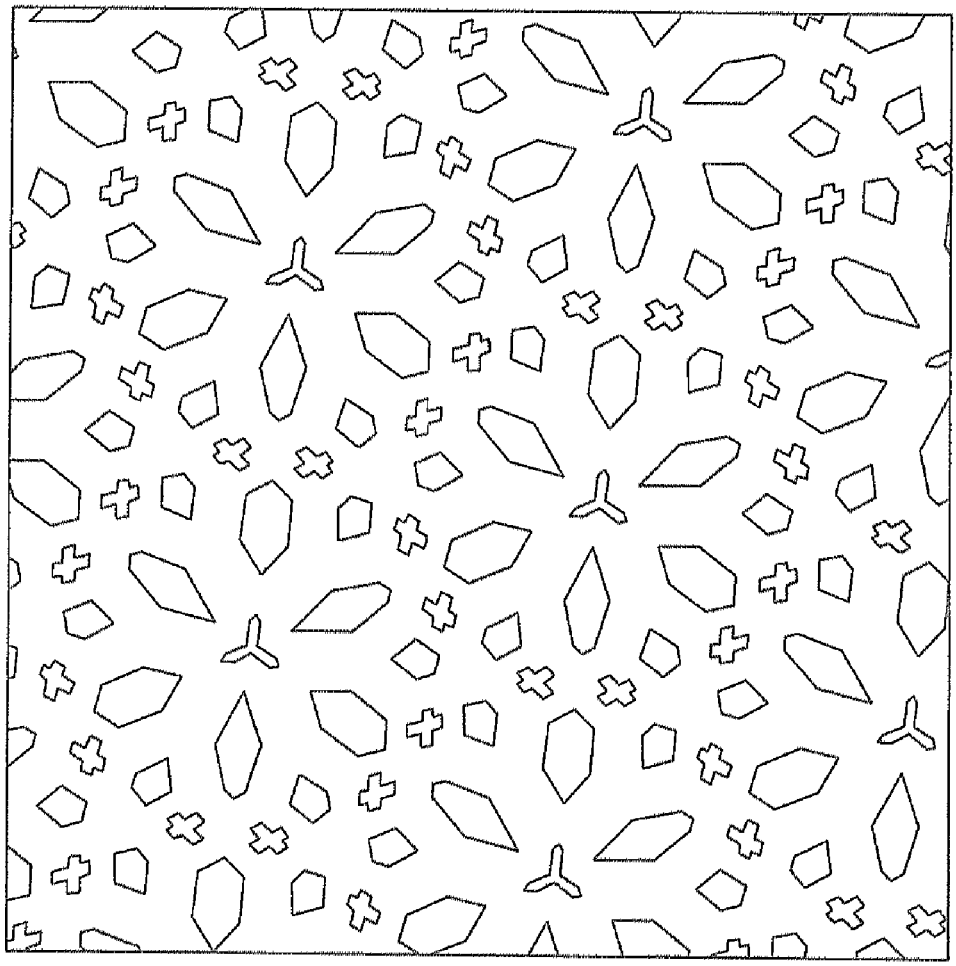
FIG. 12 shows an exemplary pattern of relative high density areas dispersed throughout a relatively low density, continuous network region having a constructal geometric pattern.

Exemplary continuous network web imprinting surfaces 222 having fractal and constructal geometries are shown in FIGS. 8-10. Alternatively, the web imprinting surface can be provided as a plurality of discontinuous imprinting regions surrounded by a continuous deflection conduit. In this circumstance, the deflection conduit is provided with a geometric shape that can be split into parts, each of which is (at least approximately) a reduced-size copy of the whole. Such geometries having fractal and constructal geometries are shown in FIGS. 11-12.

Web Product

As shown in FIGS. 5-7, the paper product produced according to the present invention is macroscopically monoplanar where the plane of the paper defines its X-Y directions and having a Z direction orthogonal thereto. The molded web 120B formed by the process shown in FIG. 1 is characterized in having relatively high tensile strength and flexibility for a given level of web basis weight and web caliper H. This relatively high tensile strength and flexibility is believed to be due, at least in part, to the difference in density between the relatively high density region 1083 and the relatively low density region 1084. Web strength is enhanced by pressing a portion of the intermediate web 120A between the first dewatering felt 320 and the web imprinting surface 220 to form the relatively high density region 1083. Simultaneously compacting and dewatering a portion of the web provides fiber to fiber bonds in the relatively high density region for carrying loads.

A paper product produced according to the apparatus and process of the present invention has at least two regions. The first region comprises an imprinted region which is imprinted against the web imprinting surface 220 of the foraminous printing member 219. The imprinted region is preferably an essentially continuous network. The relatively low density region 1084 deflected into the deflection conduit portion 230 of the imprinting member 219 provides bulk for enhancing absorbency.

It was surprisingly found that a web product formed by the use of a web imprinting surface 222 having a continuous network web imprinting surface 222 with a geometry exhibited by equation 2 (above) (and alternatively and correspondingly the web imprinting surfaces 222*a* of FIG. 3) exhibited several remarkable performance enhancements. This included a surprising increase in the observed VFS and SST values and a surprising decrease in the observed residual water values ($R_W$) over other commercial products tested.

The difference in density between the relatively high density region 1083 and the relatively low density region 1084 is provided, in part, by deflecting a portion of the embryonic web 120 into the deflection conduit portion 230 of the imprinting member 219 to provide a non-monoplanar intermediate web 120A upstream of the compression nip 300. A monoplanar web carried through the compression nip 300 would be subject to some uniform compaction, thereby increasing the minimum density in the molded web 120B. The portions of the non-monoplanar intermediate web 120A in the deflection conduit portion 230 avoid such uniform compaction, and therefore maintain a relatively low density. However, without being bound by theory, it is believed the relatively low density region 1084 and the relatively high density region 1083 may have generally equivalent basis weights. In any regard, the density of the relatively low density region 1084 and the relatively high density region 1083 can be measured according to U.S. Pat. Nos. 5,277,761 and 5,443,691.

The molded web 120B may also be foreshortened, as is known in the art. Foreshortening can be accomplished by creping the molded web 120B from a rigid surface such as a drying cylinder. A Yankee drying drum can be used for this purpose. During foreshortening, at least one foreshortening ridge can be produced in the relatively low density regions 1084 of the molded web 120B). Such at least one foreshortening ridge is spaced apart from the MD/CD plane of the molded web 120B in the Z-direction. Creping can be accomplished with a doctor blade according to U.S. Pat. No. 4,919,756. Alternatively or additionally, foreshortening may be accomplished via wet micro-contraction as taught in U.S. Pat. No. 4,440,597 and/or by fabric creping as would be known to those of skill in the art.

EXAMPLE

Example 1

A pilot scale Fourdrinier papermaking machine is used in the present example. A 3% by weight aqueous slurry of northern softwood kraft (NSK) pulp is made up in a conventional re-pulper and may be diluted to a ≈0.1% consistency in a stock chest. The NSK slurry is refined gently and a 2% solution of a permanent wet strength resin (i.e. Kymene 5221 marketed by Hercules incorporated of Wilmington, Del.) is added to the NSK stock pipe at a rate of 1% by weight of the dry fibers. The adsorption of Kymene 5221 to NSK is enhanced by an in-line mixer. A 1% solution of Carboxy Methyl Cellulose (CMC) (i.e. FinnFix 700 marketed by C.P. Kelco U.S. Inc. of Atlanta, Ga.) is added after the in-line mixer at a rate of 0.2% by weight of the dry fibers to enhance the dry strength of the fibrous substrate. A 3% by weight aqueous slurry of Eucalyptus fibers is made up in a conventional re-pulper. A 1% solution of defoamer (i.e. BuBreak 4330 marketed by Buckman Labs, Memphis Tenn.) is added to the Eucalyptus stock pipe at a rate of 0.25% by weight of the dry fibers and its adsorption is enhanced by an in-line mixer.

The NSK furnish and the Eucalyptus fibers are combined in the head box and deposited onto a Fourdrinier wire homogenously to form an embryonic web. The Fourdrinier wire Dewatering occurs through the Foudrinier wire and is assisted by a deflector and vacuum boxes. The Fourdrinier wire is of a 5-shed, satin weave configuration having 84 machine-direction and 76 cross-machine-direction monofilaments per inch, respectively. The embryonic wet web is transferred from the Fourdrinier wire, at a fiber consistency of about 15% to about 25% at the point of transfer, to a to photo-polymer fabric having a fractal pattern cells, about 25 percent knuckle area and 22 mils of photo-polymer depth. The speed differential between the Fourdrinier wire and the patterned transfer/imprinting fabric is about −3% to about +3%. Further de-watering is accomplished by vacuum assisted drainage until the web has a fiber consistency of about 20% to about 30%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before the dry creping the web with a doctor blade. The doctor blade has a bevel angle of about 25 degrees and is positioned with respect to the Yankee dryer to provide an impact angle of about 81 degrees; the Yankee dryer is operated at about 600 fpm (feet per minute) (about 183 meters per minute). The dry web is formed into roll at a speed of 560 fpm (171 meters per minutes).

Two plies of the web are formed into paper towel products by embossing and laminating them together using PVA adhesive. The paper towel has about 53 g/m$^2$ basis weight and contains 65% by weight Northern Softwood Kraft and 35% by weight Eucalyptus furnish.

Example 2

The NSK furnish and the Eucalyptus fibers are prepared by a method similar to that of Example 1, combined in the head box and deposited onto a Fourdrinier wire, running at a velocity $V_1$, homogenously to form an embryonic web.

The web is then transferred to the patterned transfer/imprinting fabric in the transfer zone without precipitating substantial densification of the web. The web is then forwarded, at a second velocity, $V_2$, on the transfer/imprinting fabric along a looped path in contacting relation with a transfer head disposed at the transfer zone, the second velocity being from about 5% to about 40% slower than the first velocity. Since the wire speed is faster than the transfer/imprinting fabric, wet shortening of the web occurs at the transfer point. Thus, the wet web foreshortening may be about 3% to about 15%.

The web is then adhered to the surface of a Yankee dryer, having a third velocity ($V_3$) by a method similar to that of Example 1. The fiber consistency is increased to an estimated 96%, and then the web is creped from the drying cylinder with a doctor blade, the doctor blade having an impact angle of from about 90 degrees to about 130 degrees. Thereafter the dried web is reeled at a fourth velocity ($V_4$) that is faster than the third velocity ($V_3$) of the drying cylinder.

Two plies of the web made according to Example 1 can be combined to form a multi-ply product by embossing and/or by laminating them together using a PVA adhesive. The paper towel can have about 53 g/m$^2$ basis weight and contains 65% by weight Northern Softwood Kraft and 35% by weight Eucalyptus furnish.

Any dimension and/or value disclosed herein is not to be understood as strictly limited to the exact numerical values recited. Instead, unless otherwise specified, each dimension and/or value is intended to mean both the recited dimension and/or value and a functionally equivalent range surrounding that dimension and/or value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A patterned framework for a papermaking belt having an embryonic-web-contacting surface for carrying an embryonic web of paper fibers and a non-embryonic-web-contacting surface opposite said embryonic-web-contacting surface, said patterned framework comprising:

a continuous network region; and, a plurality of discrete regions, said discrete regions being isolated from one another by said continuous network region; and, wherein said continuous network region comprises a pattern formed therein, said pattern comprising a plurality of tessellating unit cells;

wherein each cell of said plurality of unit cells comprises a center and at least two continuous land areas extending in at least two directions from said center, each discrete region being surrounded by a portion of at least one of said continuous land areas;

wherein at least one of said continuous land areas at least bifurcates to form a continuous land area portion having a first width, $W_1$, before said bifurcation and at least two continuous land area portions having a second width, $W_2$, and third width, $W_3$, after said bifurcation respectively, each of said at least two continuous land area portions having said second width being in continuous communication with said continuous land area portion having said first width, said widths having the relationship $W_1<W_2+W_3$; and, wherein each of said continuous portions having said first width has a first number density within said cell;

wherein each of said at least two continuous portions having said second width has a second number density within said cell; and, wherein said first number density is less than said second number density.

2. The patterned framework for a papermaking belt of claim 1 wherein said first width is greater than said second width.

3. The patterned framework for a papermaking belt of claim 1 wherein said first width is less than said second width.

4. The patterned framework for a papermaking belt of claim 1 wherein said pattern comprises a geometric shape that can be split into parts, each of which is a reduced-size copy of the whole.

5. The patterned framework for a papermaking belt of claim 4 wherein said pattern is selected from the group consisting of fractals, constructals, and combinations thereof.

6. The patterned framework for a papermaking belt of claim 5 wherein said fractal is selected from the group consisting of escape-time fractals, Mandelbrot set fractals, Julia set fractals, Burning Ship fractals, Nova fractals, Lyapunov fractals, an iterated function system, Random fractals, Strange attractors, and combinations thereof.

7. The patterned framework for a papermaking belt of claim 5 wherein said fractal is a Mandelbrot fractal where $z_1=(z_0)^2+z_0$ and where $z_{x+1}=((z_x)^2+z_x$.

8. A patterned framework for a papermaking belt having an embryonic-web-contacting surface for carrying an enthryonic web of paper fibers and a non-embryonic-web-contacting surface opposite said embryonic-web-contacting surface, said patterned framework comprising:

a continuous network region; and, a plurality of discrete regions, said discrete regions being isolated from one another by said continuous network region;

wherein said continuous network region comprises a pattern formed therein, said pattern comprising a plurality of tessellating unit cells;

wherein each cell of said plurality of unit cells comprises a center, at least two continuous land areas extending in at least two directions from said center, each discrete region being surrounded by a portion of at least one of said continuous land areas;

wherein at least one of said continuous land areas at least bifurcates to form a continuous land area portion having a first width, $W_1$, before said bifurcation and at least two continuous and area portions, a first of said at least two continuous land area portions having a second width, $W_2$, after said bifurcation, a second of said at least two continuous land area portions having a third width, $W_3$, after said bifurcation, each of said at least two continuous land area portions being in continuous communication with said continuous land area portion having said first width and satisfying, the relationship $W_1<W_2+W_3$, where $W^2$ and $W_3\neq 0$; and, wherein each of said continuous portions having said first with has a first number density within said cell;

wherein each of said at least two continuous portions having said second width has a second number density within said cell; and, wherein said first number density is less than said second number density.

9. The patterned framework for a papermaking belt of claim 8 wherein said first width is greater than said second width and said third width.

10. The patterned framework for a papermaking belt of claim 9 wherein said second width is greater than said third width.

11. The patterned framework for a papermaking belt of claim 8 wherein said first width is less than said second width.

12. The patterned framework for a papermaking belt of claim 11 wherein said second width is equal to said third width.

13. The patterned framework for a papermaking belt of claim 8 wherein said pattern comprises a geometric shape that can be split into parts each of which is a reduced-size copy of the whole.

14. The patterned framework for a papermaking belt of claim 13 wherein said pattern is selected from the group consisting of fractals, constructals, and combinations thereof.

15. The patterned framework for a papermaking belt of claim 14 wherein said fractal is selected from the group consisting of escape-time fractals, Mandelbrot set fractals, Julia set fractals, Burning Ship fractals, Nova fractals, Lyapunov fractals, an iterated function system, Random fractals, Strange attractors, and combinations thereof.

16. The patterned framework for a papermaking belt of claim 14 wherein said fractal is a Mandelbrot fractal where $z_1=(z_0)^2+z_0$ and where $z_{x+1}=((z_x)^2+z_x$.

17. A patterned framework for a papermaking belt having an embryonic-web-contacting surface for carrying an embryonic web of paper fibers and a non-embryonic-web-contacting surface opposite said embryonic-web-contacting surface, said patterned framework comprising:

a continuous region; and, a plurality of discrete regions, said discrete regions being isolated from one another by said continuous region;

wherein said continuous region comprises a pattern formed therein, said pattern comprising a plurality of tessellating unit cells;

wherein each cell of said plurality of tessellating unit cells comprises a center, at least two continuous pillow areas extending in at least two directions from said center, each discrete region being surrounded by a portion of at least one of said continuous region;

wherein at least one of said continuous regions at least bifurcates to form a continuous portion having a first width, $W_1$, before said bifurcation and at least two continuous portions having a second width, $W_2$, and a third width, $W_3$, after said bifurcation respectively, each of said at least two continuous portions having said second width and third width being in continuous communication with said continuous portion having said first width and satisfying the equation $W_1<W_2+W_3$, where $W_2\neq W_3$, and where $W_2$, $W_3>0$;

wherein each of said continuous portions having said first width has a first number density within said cell;

wherein each of said at least two continuous portions having said second width has a second number density within said cell; and, wherein said first number density is less than said second number density.

18. The patterned framework for a papermaking belt of claim 17 wherein said pattern is selected from the group consisting of fractals, constructals, and combinations thereof.

19. The patterned framework for a papermaking belt of claim 18 wherein said fractal is selected, from the group consisting of escape-time fractals, Mandelbrot set fractals, Julia set fractals, Burning Ship fractals, Nova fractals, Lyapunov fractals, an iterated function system, Random fractals, Strange attractors, and combinations thereof.

20. The patterned framework for a papermaking belt of claim 19 wherein said fractal is a Mandelbrot fractal where $z_1=(z_0)^2+z_0$ and where $z_{x+1}=((z_x)^2+z_x$.

* * * * *

UNITED STATES PATENT AND TRADEMARK OFFICE

CERTIFICATE OF CORRECTION

PATENT NO. : 8,313,617 B2
APPLICATION NO. : 12/859501
DATED : November 20, 2012
INVENTOR(S) : Osman Polat et al.

It is certified that error appears in the above-identified patent and that said Letters Patent is hereby corrected as shown below:

In the Claims:

Column 21, lines 23-24, delete "enthryonic" and insert -- embryonic --.

Column 21, line 42, delete "and" and insert -- land --.

Column 21, line 49, delete the "," following "satisfying".

Column 21, line 49, delete "<" and insert -- ≤ --.

Column 21, line 50, delete "$W^2$" and insert -- $W_2$ --.

Column 21, line 52, delete "with" and insert -- width --.

Column 22, line 44, delete "<" and insert -- ≤ --.

Signed and Sealed this
Third Day of September, 2013

Teresa Stanek Rea

Teresa Stanek Rea
*Acting Director of the United States Patent and Trademark Office*